US009960565B2

(12) United States Patent
Manser

(10) Patent No.: US 9,960,565 B2
(45) Date of Patent: May 1, 2018

(54) METHOD AND DEVICE FOR PRODUCING AN OPERATIVE CONNECTION BETWEEN A CONNECTOR AND A CABLE

(71) Applicant: Franz Manser, Herisau (CH)

(72) Inventor: Franz Manser, Herisau (CH)

(73) Assignee: Huber+Suhner AG, Herisau (CH)

( * ) Notice: Subject to any disclaimer, the term of this patent is extended or adjusted under 35 U.S.C. 154(b) by 0 days. days.

(21) Appl. No.: 14/401,639

(22) PCT Filed: Apr. 25, 2013

(86) PCT No.: PCT/EP2013/058601
§ 371 (c)(1),
(2) Date: Nov. 17, 2014

(87) PCT Pub. No.: WO2013/171049
PCT Pub. Date: Nov. 21, 2013

(65) Prior Publication Data

US 2015/0104973 A1 Apr. 16, 2015

(30) Foreign Application Priority Data

May 15, 2012 (CH) ..... 684/12

(51) Int. Cl.
*H01R 43/28* (2006.01)
*H01R 43/00* (2006.01)
(Continued)

(52) U.S. Cl.
CPC ..... *H01R 43/28* (2013.01); *H01B 7/38* (2013.01); *H01B 11/18* (2013.01); *H01R 4/20* (2013.01);
(Continued)

(58) Field of Classification Search
CPC ..... H01R 4/20; H01R 24/40; H01R 43/28; H01R 9/05; H01B 7/38; H01B 11/18; Y10T 29/49174; Y10T 29/532
(Continued)

(56) References Cited

U.S. PATENT DOCUMENTS 3,795,023 A * 3/1974 Miragliotta ..... H02G 1/1212 30/90.1
4,365,859 A * 12/1982 Hutter ..... H01R 4/2404 439/425
(Continued)

FOREIGN PATENT DOCUMENTS

EP 1 191 631 A2 3/2002
GB 2 137 823 A 10/1984
(Continued)

*Primary Examiner* — A. Dexter Tugbang
*Assistant Examiner* — Kaying Kue
(74) *Attorney, Agent, or Firm* — Pauley Erickson & Kottis

(57) ABSTRACT

A method for producing an operative connection between a coaxial cable (1) and a coaxial connector (16). A cable jacket (5), if present, is removed by means of a first tool (6) to a predefined first length L1. In a second step, an outer conductor (3) is removed by means of a second tool (7) to a predefined second length L2. In a third step, a dielectric (4) is removed by means of a third tool (8) to a third length L3, such that one end (15) of the inner conductor (2) is exposed. Then the end (15) of the inner cable conductor (2) is formed by means of a rotary swaging device (9), which comprises a plurality of deflectable jaws (10) rotatable circumferentially about an axis of rotation (11) and each hammering in the radial direction with at least one operative surface (14).

7 Claims, 3 Drawing Sheets

(51) Int. Cl.

| | |
|---|---|
| ***H01R 4/20*** | (2006.01) |
| ***H01R 24/40*** | (2011.01) |
| ***H01B 7/38*** | (2006.01) |
| ***H01B 11/18*** | (2006.01) |
| ***H01R 9/05*** | (2006.01) |

(52) U.S. Cl.
CPC ..... *H01R 9/05* (2013.01); *H01R 24/40* (2013.01); *Y10T 29/49174* (2015.01); *Y10T 29/532* (2015.01)

(58) Field of Classification Search
USPC ..... 29/748, 747, 745, 753, 761
See application file for complete search history.

(56) References Cited

U.S. PATENT DOCUMENTS 4,805,302 A * 2/1989 Steiner ..... H02G 1/1224 30/90.1
4,932,091 A * 6/1990 Krzyzanski ..... H01R 43/042 29/758
5,265,338 A * 11/1993 Cheng ..... H02G 1/1231 30/90.1
5,581,885 A * 12/1996 Dalton ..... H02G 1/1226 30/90.1
5,607,325 A * 3/1997 Toma ..... H01R 9/0524 439/578
6,513,244 B1 * 2/2003 Andreescu ..... H02G 1/1226 30/90.1
6,641,444 B2 11/2003 Hanazaki et al.
6,725,533 B1 * 4/2004 Losinger ..... H01R 43/28 29/270
7,120,997 B2 * 10/2006 Islam ..... B25B 27/10 29/748
7,137,204 B2 * 11/2006 Wiste ..... H02G 1/1214 30/113
7,174,633 B2 2/2007 Onuma
7,188,507 B2 * 3/2007 Holliday ..... B21D 39/048 29/282
7,210,327 B1 * 5/2007 Tarpill ..... B25B 27/10 29/751
7,887,359 B2 * 2/2011 Manser ..... H01R 13/6272 439/350
8,075,339 B2 * 12/2011 Holliday ..... H01R 9/0518 439/584
8,307,544 B2 * 11/2012 Natoli ..... H01R 43/0425 29/748
8,661,656 B2 * 3/2014 Chawgo ..... H01R 43/0427 29/748
9,071,045 B2 * 6/2015 Furukawa ..... H01R 4/185
2002/0009540 A1 * 1/2002 Sasaki ..... H05B 3/145 427/117
2004/0134965 A1 * 7/2004 Stepan ..... H02G 1/1248 228/1.1
2005/0050713 A1 * 3/2005 Locher ..... H01R 43/05 29/564.4
2006/0011376 A1 * 1/2006 Van Den Berg ... H01B 11/1834 174/120 R
2009/0011663 A1 * 1/2009 Morikawa ..... H01R 9/053 439/877
2010/0064522 A1 * 3/2010 Vaccaro ..... H01R 43/28 30/90.1
2010/0126011 A1 * 5/2010 Islam ..... H01R 9/05 29/867
2010/0255718 A1 * 10/2010 Cook ..... H01R 9/0524 439/578
2011/0244721 A1 * 10/2011 Amidon ..... H01R 9/05 439/578
2012/0125654 A1 * 5/2012 Van Swearingen ..... H01R 4/26 174/82
2015/0096781 A1 * 4/2015 Fichtner ..... H01B 13/0006 174/102 R

FOREIGN PATENT DOCUMENTS

| | | | |
|---|---|---|---|
| GB | 2 369 255 | A | 5/2002 |
| JP | S53-90990 | U | 7/1978 |
| JP | H09-140023 | A | 5/1997 |
| JP | 2002-158044 | A | 5/2002 |
| JP | 2009-151985 | A | 7/2009 |
| WO | WO 03/080269 | A1 | 10/2003 |

* cited by examiner

METHOD AND DEVICE FOR PRODUCING AN OPERATIVE CONNECTION BETWEEN A CONNECTOR AND A CABLE

BACKGROUND OF THE INVENTION

Field of the Invention

The invention relates to the field of coaxial cables and coaxial connectors for operatively connecting such coaxial cables, and to the working of the coaxial cables and the coaxial connectors to form assemblies.

Discussion of Related Art

Coaxial cables for transmitting signals with high frequencies are known from the prior art. These cables comprise an inner conductor which is surrounded by a dielectric, an outer conductor and a cable sheath. Such cables are dimensioned according to their field of application and the signal strength to be transmitted. The prior art discloses connectors for connecting such cables. Such connectors also have a coaxial structure and are adapted to the dimensions of the cable. This means that practically every cable requires a connector that is adapted to its dimensions, and this leads to a huge range of variants.

Rotary swaging machines, by means of which ductile materials can be deformed either continuously or intermittently, have been known from the prior art since the beginning of the last century. These rotary swaging machines generally have a forming tool consisting of two or four jaws arranged opposite one another in pairs. The jaws of the forming tool are for example deflected inwards in the radial direction by means of circumferential rollers. At the same time, said jaws move in the circumferential direction. The forming tool has a central working opening which is mostly continuous and has a cross section that tapers in the longitudinal direction. Workpieces to be processed can be inserted into the working opening of the forming tool and removed via the same opening or via a second opposite opening in the case of a continuous process. The workpiece is continuously deformed within the working opening by means of the jaws which move in the radial and circumferential direction. As a result of the movement of the jaws, the working opening has a variable cross section. Rotary swages are used for example in the production of wire ropes or forged pieces in the motor industry. A number of fields of application for rotary swaging machines are known from patent literature. A few select examples will be briefly described below.

U.S. Pat. No. 6,641,444B2 from Yazaki Corporation, granted on 4 Nov. 2003, describes a structure and a method for joining an electric cable and a cable end piece by means of rotary swaging. For this purpose, the insulation is stripped at the cable end only, so that the stranded conductor is exposed. Said stranded conductor is then slid into a hollow cylindrical bush. Next, the bush is compressed in the radial direction by means of rotary swaging. This compression compacts the stranded conductor and thus reduces the electrical resistance.

U.S. Pat. No. 7,174,633B2 from Yazaki Corporation, granted on 13 Feb. 2007, also describes a method for connecting an electric cable to a cable end piece. To do this, an electrically conductive adhesive (e.g. a paste made of epoxy and nickel powder) is filled into a tubular end of a cable end piece. Next, the stranded conductor of the cable end, having been stripped beforehand, is inserted into the hole. The tubular cable end piece is then radially compressed by means of rotary swaging and brought into tight contact with the stranded conductor. In this case, the nickel powder in the paste, as the conductive filler, should destroy any possible oxide layers on the metal parts and increase the conductivity.

US Patent application US2011244721A from John Mezzalingua Associates, Inc., published on Jun. 10, 2011, relates to a method for terminating a coaxial cable. Firstly, a portion of the insulating layer is removed. The diameter of the inner conductor is then reduced in some portions by means of a rotatable coaxial-cable finishing tool and a part of the insulator is removed (cored out) at the same time. Lastly, an outer connecting structure is attached to the inner connecting structure. Also disclosed are a tool for finishing a coaxial cable and a finished coaxial cable. This application does not give any suggestion of rotary swaging in the aforementioned sense.

International Patent Application WO03080269 from Boeing Company, published on Feb. 10, 2003, relates to the termination of bracing wires in aircraft, in which bushes on the ends are deformed by rotary swaging into balls for the introduction of a load.

British Patent Application GB2137823, published on Oct. 10, 1984, relates to a soot barrier for a coaxial cable. Only claim 11 mentions that the bush can be attached by means of rotary swaging.

European Patent Application EP 11.91631 from Yazaki Corporation, published on 27 Mar. 2002, relates to a method for connecting a terminal to a wire. The terminal comprises a connection portion which is designed as an open bush and is compressed over the entire edge thereof, for example by rotary swaging.

SUMMARY OF THE INVENTION

It is an object of the invention to disclose a method for providing a coaxial cable. It is also an object of the invention to disclose a method for operatively connecting a coaxial cable according to the invention to a coaxial connector according to the invention. Additional objects of the invention consist in the disclosure of a coaxial cable, a coaxial connector, and a cable assembly having improved transmission properties.

This object is achieved by the invention defined in the claims.

When connecting coaxial cables to a connector, it is essential to satisfy various conditions and criteria in order to ensure an optimum connection. On the one hand, whenever possible the resistance should be for example 50 ohm or 75 ohm. On the other hand, abrupt changes in the diameter, which lead to undesirable reflection of signals, or burrs should be avoided. Damage to the surface or the surface coating of the cable inner conductor should also be avoided, since this too can lead to a deterioration in the transmission behavior.

A further aspect of the invention is based on the possibility of using structurally identical connectors, where possible, for cables of different diameters. The aim behind this is to reduce the number of different connectors. This is achieved by different cable inner conductors being provided with a standard end which allows the same or only slightly variable coaxial connectors to be used for different cable diameters, in that in that the coaxial connectors have the same internal structure.

Nowadays, conventional coaxial cables comprise inner conductors made of one single wire or a stranded inner conductor made of a plurality of wires (which have been stranded together). Such stranded inner conductors have the advantage of being very flexible. On the other hand, however, it tends to be more difficult to contact the individual wires in such stranded inner conductors.

A further aspect of the invention is to give the coaxial connectors a simpler or smaller design.

These aspects of the invention can be achieved in that the end, to be connected, of the coaxial cable is processed by means of a method according to the invention. Depending on the embodiment, said method comprises the following method steps. It should be noted that, depending on the field of application, individual method steps can be omitted, the sequence of individual method steps can be changed or certain method steps can be combined. In a first step, a cable sheath (if provided) is removed over a defined first length, exposing an outer conductor. If necessary, the outer conductor is also removed over a defined second length, so that a dielectric arranged between the cable inner conductor and the outer conductor is exposed. In a further step, the dielectric is removed over a defined third length, so that a central cable inner conductor arranged coaxially with the outer conductor is exposed. In certain cases, the first and/or the second and/or the third lengths can be identical. The cable inner conductor is cut to a particular length. The cable inner conductor is then deformed in one or more steps by means of a rotary swaging device according to the invention such that said inner conductor is given a predetermined shape. The rotary swaging device comprises at least two jaws which are arranged so as to be rotatable about an axis. At the same time, the jaws are arranged so as to be movable in the radial direction with respect to the axis. A first drive is used to rotate the jaws about the axis. A second drive is used to drive the jaws in a hammering manner in the radial direction, while the jaws rotate about the axis. The jaws each have at least one active surface which is directed inwardly towards the axis and is used to process a workpiece inserted between the jaws. During processing of the workpiece, the shape of the at least one active surface is transferred to the workpiece. Depending on the embodiment, the inner conductor can be cut to length by the rotary swaging device or said cutting can be integrated in said rotary swaging device by means of an appropriate configuration of the jaws. The drives of the jaws are generally configured such that their movements are superposed. For example, the jaws are rotated continuously about the axis and at the same time carry out an inward, hammering movement in the process. This compresses the material of the workpiece. A further advantage is that the gentle treatment does not lead to destruction of a surface coating which may be present.

Depending on the field of application, the cable inner conductor has regions of different diameters following deformation. Said regions advantageously transition smoothly into one another, sharp edges or uncontrolled abrupt diameter changes generally being avoided. In certain applications, retaining means or attachment means (e.g. barbs) can be integrally formed by means of rotary swaging. For example, circumferential groove-like recesses or ridges can be integrally formed which are used to increase the retaining forces between the cable inner conductor and a connector inner conductor operatively connected thereto.

In one embodiment, a bush is placed on the end of the cable inner conductor prior to deformation. The bush is then deformed together with the cable inner conductor and is thus given a new geometry at least in some regions. The bush can be used as an adapter for connecting a coaxial connector. Alternatively, the bush can also be used as an inner conductor of a coaxial connector. When necessary, the bush can have barbs, by means of which the bush can be anchored in a dielectric of a coaxial connector. The barbs can likewise be shaped by means of rotary swaging using either the same or a different tool. When necessary, one or more barbs can be integrally formed on the inner conductor, for example if the inner conductor of the cable is used as an inner conductor of the connector.

The advantages of this process are very precise deformation with low tolerances (typically ±0.02 mm) and with very good reproducibility and accuracy of repetition. Other advantages are a precise round geometry, in particular with small cable lead-ins. The result of this is significantly improved adaptation at high frequencies owing to the high reproducibility or process reliability. Steps inside the connectors, as occur nowadays as a result of crimping and soldering, can be avoided. For example, it is possible to place a bush onto a cable inner conductor and to deform said bush by means of rotary swaging on one hand, and to interconnect these on the other hand, so that both parts at the end have the same diameter in the transition region or merge into one another with a smooth outer surface. A further advantage is that the same parts can be used without difficulty in various configurations. This reduces the number of parts. A further advantage is that connectors in accordance with the method according to the invention can have a shorter overall length, since for example the cable inner conductors can be used as inner conductors of the connector. Owing to the method according to the invention, it can also be ensured that the cable inner conductors no longer have to be deburred and sharpened in separate operations. This reduces the risk of swarfs entering the interior of connectors and assemblies. It is also possible to reduce the risk of burrs being produced in cable inner conductors, which burrs damage sockets. The deformation according to the invention of cable inner conductors produces the advantages that same parts/subassemblies can be used in different cables. As a result, the diameter and the length of the connectors can be reduced, and this has a positive effect inter alia on material consumption (depending on the field of application, it is possible to reduce the overall size of the inner conductor and the body by approximately 40%). In angled connectors, multiple contacts as a result of intermediate pieces can be prevented.

Further advantages are that a thicker portion, for example a ball, can be formed integrally on the end of an inner conductor by means of rotary swaging. This is advantageous in that compressed sockets on the mating side can thus be omitted. In addition, it is possible, when necessary, to provide the end of the inner conductor with one of more circumferential grooves and/or bulges, or to apply other shapes which have a positive effect on the retaining force and the quality of the signal transmission.

As a result of the rotary swaging according to the invention, parts can be operatively interconnected by means of cold welding. Crimping and soldering processes, which are complex in particular in cases of small parts (diameters), can thereby be avoided or replaced. In addition, it is possible to avoid the contact problems in inner conductors, which problems occur for example with square crimp connections, and to improve the PIM behavior (passive intermodulation). The problem of embrittling solder points (gold in tin) does not arise either. When necessary, the cable inner conductors can also be deformed over the entire cable length by means of rotary swaging. A further advantage is that, owing to the rotary swaging according to the invention, sheet material which has been coated on one side is used instead of a solid material, and this has a positive effect on production costs.

In one variant, in order to produce an operative connection between a coaxial cable and a coaxial connector, the method according to the invention comprises the following method steps: (a) removing a cable sheath (if provided) over a defined first length by means of a first tool; (b) removing a cable outer conductor over a defined second length by means of a second tool; (c) removing a dielectric over a third length by means of a third tool, so that an end of the inner conductor is exposed; (d) providing a rotary swaging device comprising a plurality of jaws, which are rotatable about an axis of rotation in the circumferential direction, can be deflected in a hammering manner in the radial direction and each comprise at least one active surface; (e) introducing an end of the inner conductor into the active region of the active surfaces so that the shape of the active surfaces is transferred to the end of the inner conductor and the end has at least one portion having a defined diameter; (f) providing a coaxial connector; (g) pushing the inner conductor into a cable opening in a housing of the coaxial connector until the portion having the defined diameter has reached a defined position inside the connector. In order to operatively connect the cable inner conductor to a coaxial connector according to the invention, the end of the cable inner conductor can be pushed into a connection opening in a connector inner conductor. Alternatively or in addition, the end of the cable inner conductor can be pushed into a bush. The bush can be rotary swaged together with the cable inner conductor. In one embodiment, the cable inner conductor can be pushed through a central hole in an insulator of the connector until it forms the connector inner conductor. A device for the processing, according to the invention, of a coaxial cable may comprise a first tool for removing a cable sheath over a defined length. In addition, the device may comprise a second tool for removing an outer conductor over a defined length. The device may also comprise a third tool for removing a dielectric over a defined length. The device comprises a rotary swaging device having a plurality of jaws which are rotatable about an axis of rotation, can be deflected relative thereto in the radial direction and each have at least one active surface for processing a cable end. The first and/or the second and/or the third tool can be one or more blades. The blades can be arranged in an adjustable manner or so as to be movable relative to the coaxial cable. The device may comprise a mounting for temporarily holding and positioning the coaxial cable. The device may comprise a plurality of rotary swaging devices having different active surfaces. At least one of the tools can be arranged upstream of and/or next to the rotary swaging device. When necessary, the tools can be accommodated in different housings. A coaxial cable according to the invention generally comprises a cable inner conductor, a cable outer conductor arranged coaxially therewith and a dielectric arranged therebetween. One end of the cable inner conductor comprises at least one surface which has been produced using a rotary swaging device. At least one surface may comprise a coating which has been applied prior to rotary swaging. The end of the cable inner conductor may comprise a bush which is operatively connected to the cable inner conductor by means of rotary swaging. Following rotary swaging, the bush and the cable inner conductor can have the same external diameter in the joint region.

BRIEF DESCRIPTION OF THE DRAWINGS

Additional aspects of the invention will now be described in greater detail with reference to the embodiment described in the following figures, in which.

DETAILED DESCRIPTION OF THE INVENTION

Figure 1:
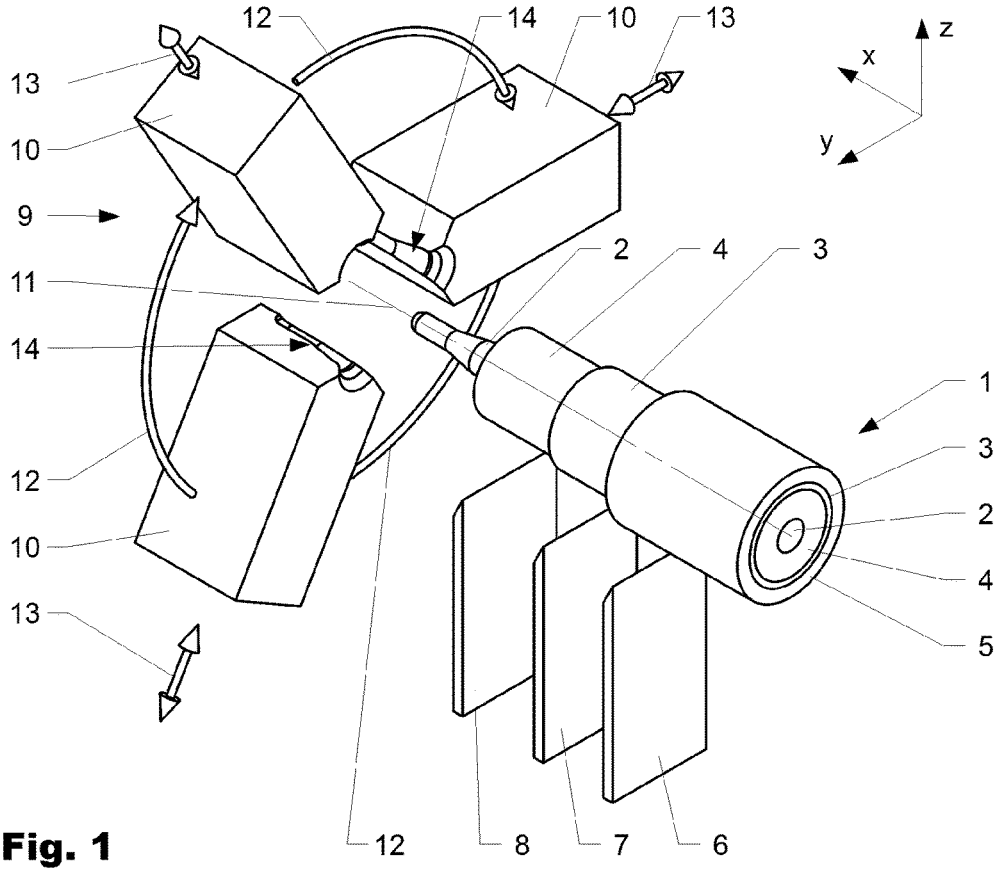
FIG. 1 is a perspective view of a method according to the invention.
Figure 2:
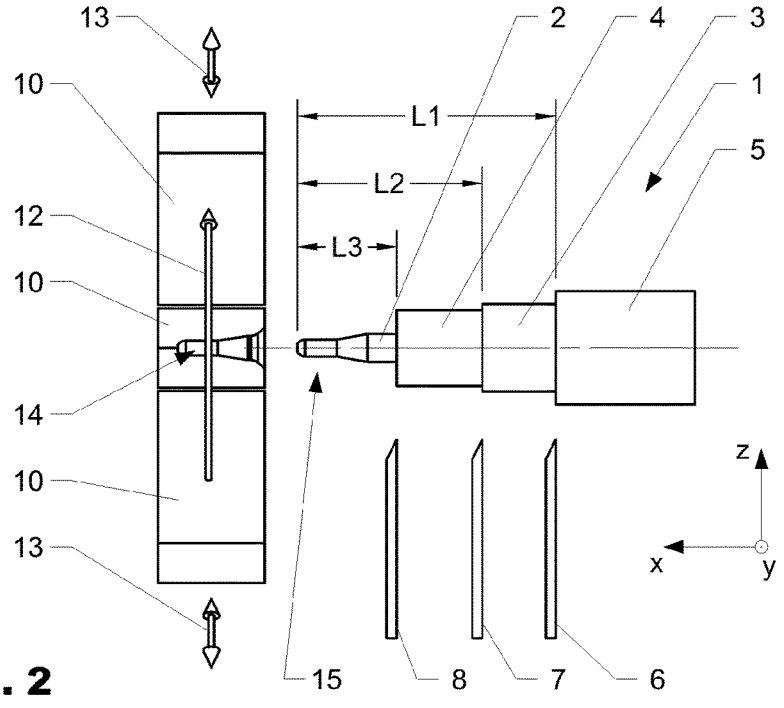
FIG. 2 is a side view of the method according to the invention.

FIG. 1 is a schematic, greatly simplified perspective view of a method according to the invention. FIG. 2 is a side view of the same method.

A coaxial cable 1 comprises an inner conductor 2, an outer conductor 3 arranged coaxially therewith and a dielectric 4 arranged therebetween. The outer conductor 3 is surrounded by a cable sheath 5.

In a first step, the cable sheath 5 is removed over a defined first length L1 by means of a first tool 6. The outer conductor 3 is then removed over a defined second length L2 by means of a second tool 7. In a further step, the dielectric 4 is removed over a third length L3 by means of a third tool 8, so that the inner conductor 2 is exposed. In one embodiment, the second and the third lengths L2, L3 are approximately the same. The inner conductor 2, which has an approximately cylindrical shape when unprocessed, is then deformed in one or more operations by means of a rotary swaging device 9 according to the invention. In the embodiment shown, the rotary swaging device 9 has three jaws 10 (other numbers of jaws, for example 2 or 4, are possible depending on the field of application) which are arranged so as to be rotatable about an axis 11 and such that they are driven in the radial direction in a deflectable manner. The rotation movement about the axis 11 and the hammering deflection movement in the radial direction are shown schematically by the first and second arrows 12, 13. The jaws 10 are shown moved apart from one another, so that the inner structure is visible. In the production position, the jaws 10 are moved together in the radial direction (second arrow 13) so as to allow shaping active surfaces 14 to act on and thus plastically deform the inner conductor 2. The result of this is that the shape of the active surfaces 14 is transferred to the end 15 of the inner conductor 2. When necessary, the deformation process can also take place in several steps by means of a plurality of rotary swaging devices 9. The coaxial cable can be prepared, i.e. the outer layers can be removed and the inner conductor 2 exposed, in a rotary swaging device 9 designed specifically for this purpose. When necessary, one or more steps can be carried out by means of one or more other tools (not shown in greater detail). The coaxial cable 1 is positioned and held precisely by means of a mounting (not shown in greater detail), at least during the rotary swaging process. In one embodiment, the tools 6-8 are designed as cutting tools and are moved towards the coaxial cable 1 in the radial direction in order to remove the outer layers 3-5 thereof until the corresponding layer is separated. The layer can then be stripped off towards the cable end 15.

FIG. 3-7 show four embodiments of connectors 16 according to the invention. The connectors 16 each comprise a housing 17 in which is arranged a connector inner conductor 18 which is held with respect to the housing 17 by an insulator 19. The housing 17 generally simultaneously acts as an outer conductor of the connector 16 for signal transmission. The connectors 16 generally also comprise a locking means 20, by means of which the connector 16 can be attached for example to a socket or to another connector (neither of these is shown in greater detail). In the connectors 16 shown in FIG. 3-7, the housing 17, the insulator 19 and the operative connection means 20 are shown in section so that the inner structure of the connector is visible.

Figure 3:
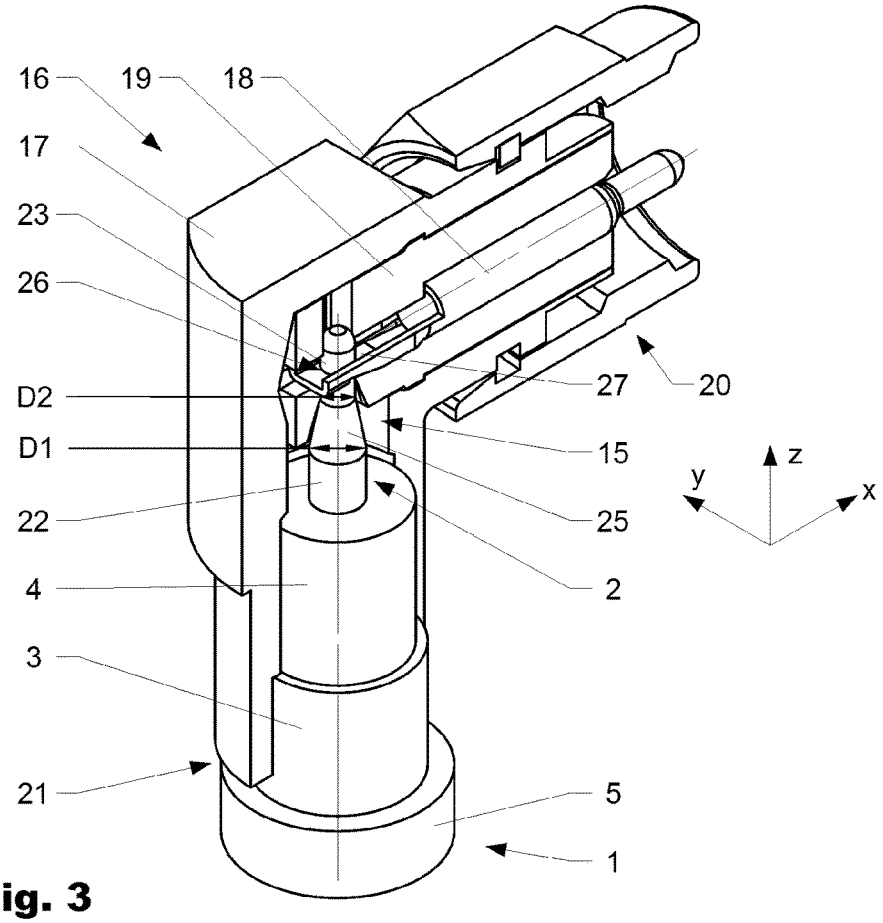
FIG. 3 shows a first embodiment of a connector according to the invention.

FIG. 3 shows an assembly 34 consisting of a connector 16 and a coaxial cable 1 operatively connected thereto. The connector 16 shown is an angular connector. The coaxial cable 1, which has been prepared by means of the method according to the invention, lies in a cable opening 21 which is arranged perpendicularly to the connector inner conductor 18. One end 15 of the inner conductor 2 is processed by rotary swaging and has a first portion 22 having a first diameter D1 and a second portion 23 having a second diameter D2. An end cap 24, which is spherical in this case, is then formed subsequently to the second portion. A conical transition surface 25 is located between the first and the second portion. An advantage of the method according to the invention is that abrupt changes in diameter, which can potentially impair signal transmission, can be avoided, even with small diameters of the inner conductor 2.

The second diameter D2 of the second portion 23 is adapted to the diameter of a connection opening 26 in the connector inner conductor 18. In the embodiment shown, the cable inner conductor 18 is produced from a sheet and has a pin-like configuration in the front region. In the rear region, where the connection opening 24 is located, said cable inner conductor has a U-shaped cross section having a clamping tongue 27 which, in the view shown, is deflected upwards (z-axis) into the connection opening 24 when the inner conductor 2 is inserted. The connection opening 24 and the clamping tongue 25 projecting into said opening are adapted to the second diameter D2 of the second portion 23 so that the inner conductor 2 is securely operatively connected thereto following insertion into the connector inner conductor 18. Other manners of attachment are possible. The connector inner conductor 18 can be given the hollow cylindrical shape, as shown, having the different diameters by means of rotary swaging.

Figure 4:
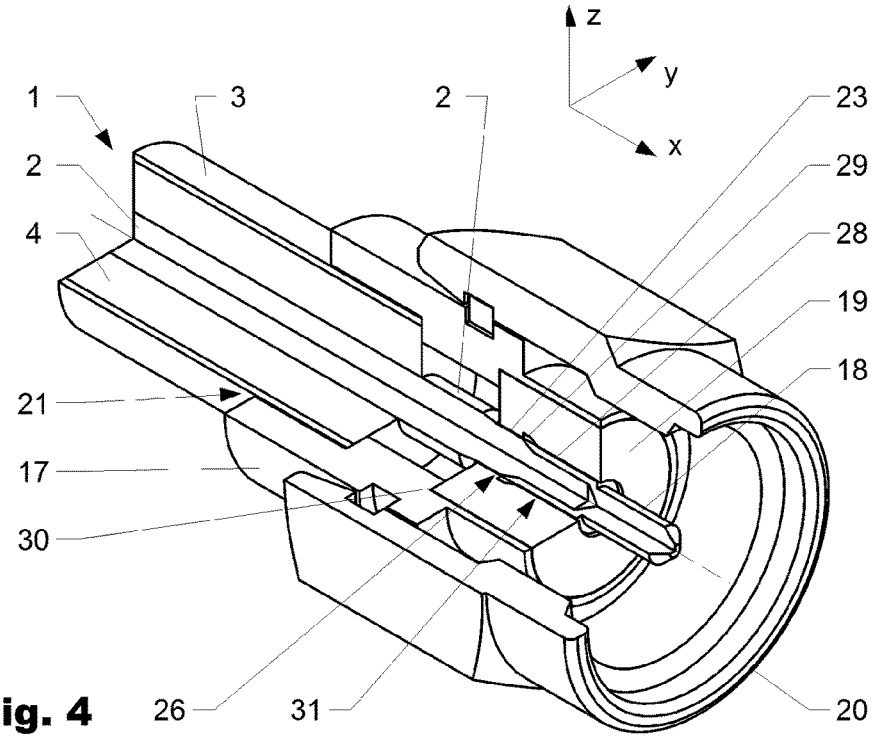
FIG. 4 shows a second embodiment of a connector according to the invention.

In the arrangement shown in FIG. 4, in addition to the connector 17 the coaxial cable 1 is also shown in section, so that the inner structure is more visible. The coaxial cable 1 is shown without a cable sheath. The connector 16 is a straight connector in which the cable inner conductor 2 and the connector inner conductor 18 are arranged on the same axis. The coaxial cable 1 is inserted into the cable opening 21 formed in the rear end of the housing 17 and the exposed outer conductor 3 is operatively connected to the housing 18. The end 15 of the inner conductor 2 is inserted into a bush 28, which simultaneously forms the connector inner conductor 18. The bush 28 is placed on the inner conductor 2 of the coaxial cable 1 beforehand and then operatively connected thereto by means of rotary swaging. One advantage is that the inner conductor 2 and the bush 28 or the connector inner conductor 18 can have the same continuous diameter (cf. second portion 23). The use of a bush 28 is advantageous when the cable inner conductor 2 is a stranded inner conductor consisting of a plurality of individual wires. The connector inner conductor 18 comprises barbs 29 which are formed integrally on the outside and are used to anchor the connector inner conductor 18 in the insulator 19 of the connector 16. In the embodiment shown, the insulator 19 is pressed into the housing 17 from the front as far as up to a first shoulder 30. The connector inner conductor 18 is then pressed, together with the cable inner conductor 2, from behind into a central hole 31 in the insulator 19, the barbs 29 anchoring themselves tightly in the material of the insulator 19. Owing to the design according to the invention, the connector 16 has the advantage of having a comparatively short overall length.

Figure 5:
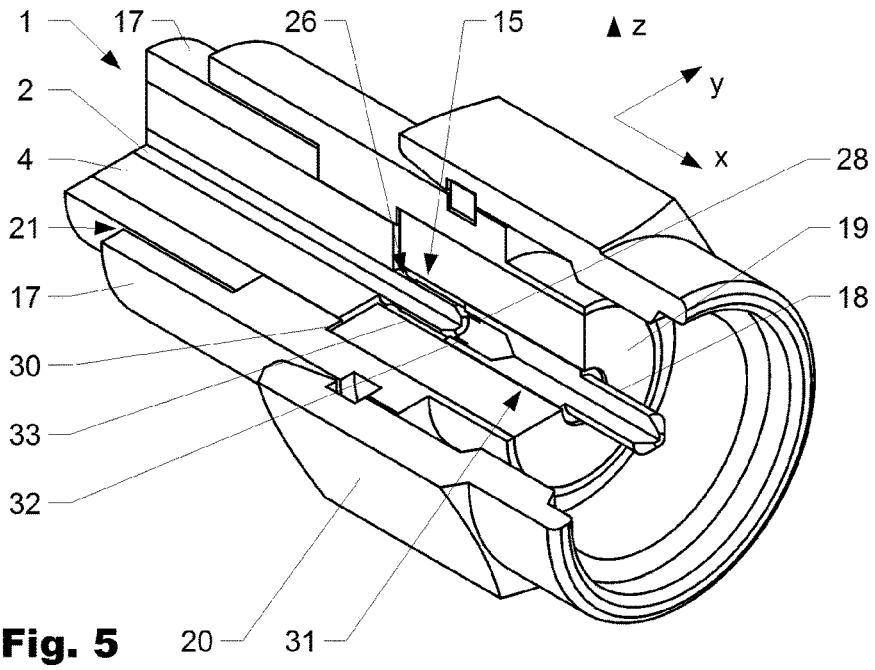
FIG. 5 shows a third embodiment of a connector according to the invention.
Figure 6:
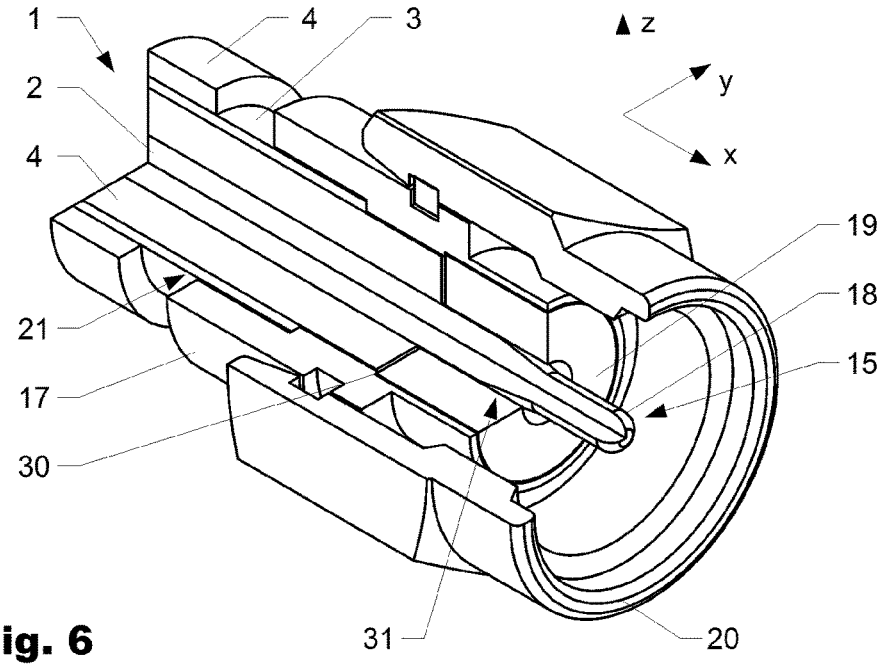
FIG. 6 shows a fourth embodiment of a connector according to the invention.

In the arrangement shown in FIG. 5, the variant has a similar construction to that of the variant shown in FIG. 4. The inner conductor 2 is what is known as a stranded inner conductor which consists of a plurality of individual wires (not shown) that have been stranded together. The end 15 of the inner conductor 2 is rotary swaged so that the individual wires are operatively interconnected by means of cold welding. When necessary, the individual wires can undergo surface treatment, for example in an immersion bath. The connector inner conductor 18 is arranged in the central hole 31 in the insulator 19 and is held thereby with respect to the housing 17 of the connector 16. The connector inner conductor 18 has a bush-shaped rear end having individual, inwardly directed spring tongues 33 which are separated by slits 32 and distributed on the circumference of the bush 28. For connection to the connector inner conductor 18, the cable inner conductor 2 is inserted into the bush-shaped region 28 of the connector inner conductor 18. In so doing, the spring tongues 33 are resiliently bent outwards so that a clamping effect is exerted on the cable inner conductor 2.

In the connectors known from the prior art, an intermediate part is required for connecting a stranded inner conductor. This is disadvantageous in that higher costs are incurred and the connector has a greater overall length. Further disadvantages reside in the multiple contacts required therefor, which can have a negative impact on signal quality.

The invention claimed is:

1. A method for producing an operative connection between a first coaxial cable and a coaxial connector, comprising the following method steps:

a. removing an outer conductor over a defined second length with a second tool;

b. removing a dielectric over a third length with a third tool, so that an end of the inner conductor is exposed;

c. providing a rotary swaging device comprising a plurality of jaws which are rotatable in the circumferential direction about an axis of rotation, that are movable in a radial direction and each comprise at least one active surface;

d. introducing the end of the inner conductor into an active region of the at least one active surface so that a shape of the at least one active surface is transferred to the end of the inner conductor and the end of the inner conductor has at least two portions, each having a different defined diameter;

e. providing the coaxial connector; and f. pushing the inner conductor into a cable opening in a housing of the coaxial connector until at least one portion having the at least one defined diameter has reached a defined position inside the coaxial connector.

2. The method according to claim 1, wherein, for operative connection, the end of the cable inner conductor is pushed into a connection opening in a connector inner conductor.

3. The method according claim 2, wherein the end of the cable inner conductor is pushed into a bush.

4. The method according to claim 3, wherein the bush is rotary swaged together with the cable inner conductor.

5. The method according to claim 1, wherein the cable inner conductor is pushed through a central hole in an insulator of the connector until said cable inner conductor forms the connector inner conductor.

6. The method according to claim 1, wherein the second and third lengths are approximately the same.

7. The method according to claim 1, wherein a cable sheath is removed over a defined first length with a first tool before removing the outer conductor over the defined second length with the second tool.

* * * * *